United States Patent [19]

Hagen

[11] Patent Number: 4,823,559

[45] Date of Patent: Apr. 25, 1989

[54] ICE MAKING APPARATUS

[76] Inventor: William F. Hagen, Rte. 1, Box 1017, Argyle, Tex. 76226

[21] Appl. No.: 182,800

[22] Filed: Apr. 18, 1988

[51] Int. Cl.[4] ..... F25C 1/12

[52] U.S. Cl. ..... 62/347; 62/515; 165/168

[58] Field of Search ..... 62/347, 348, 352, 515; 29/157.3 D; 165/168

[56] References Cited

U.S. PATENT DOCUMENTS

| | | | |
|---|---|---|---|
| 1,712,085 | 5/1929 | Litte, Jr. | 165/168 X |
| 2,805,557 | 9/1957 | Hilger | 62/347 |
| 3,074,252 | 1/1963 | Tippmann et al. | 62/347 |
| 3,246,481 | 4/1966 | Douglas et al. | 62/347 X |
| 3,430,452 | 3/1969 | Dedricks et al. | 62/347 |
| 4,107,943 | 8/1978 | Ohling | 62/347 X |
| 4,341,087 | 7/1982 | Van Steenburgh, Jr. | 62/233 |
| 4,354,360 | 10/1982 | Fiske | 62/348 X |
| 4,366,679 | 1/1983 | Van Steenburgh, Jr. | 62/347 |
| 4,458,503 | 7/1984 | Nelson | 62/347 |
| 4,526,014 | 7/1985 | Suyama et al. | 62/347 |
| 4,601,178 | 7/1986 | Suyama et al. | 62/347 |
| 4,669,276 | 6/1987 | Sakai et al. | 62/347 |

FOREIGN PATENT DOCUMENTS

| | | | |
|---|---|---|---|
| 2929888 | 2/1981 | Fed. Rep. of Germany | 29/157.3 D |

*Primary Examiner*—William E. Tapolcai
*Attorney, Agent, or Firm*—James E. Bradley

[57] ABSTRACT

An ice making apparatus uses a pair of heat transfer plates welded together. Passages are formed between the plates for the passage of a refrigerant fluid. A stream of water passes down over the refrigerant portion of the plates, which are oriented vertically. A deflecting area is located below the refrigerant portion on the plates. The deflecting area has an outward inclined section, a curved section joining the outward inclined section and an inward inclined section that leads into a water trough. Water flows around the deflecting area and into the trough during the ice forming cycle. During the harvest cycle, hot refrigerant causes the ice sheet to release, contact the deflecting area and fall past the trough into a collection bin.

11 Claims, 2 Drawing Sheets

ICE MAKING APPARATUS

BACKGROUND OF THE INVENTION

1. Field of the Invention

This invention relates in general to ice making devices, and in particular to an ice making device that forms ice on a chilled vertical plate by running water down over the plate into a recirculating trough.

2. Description of the Prior Art

One type of ice making machine for commercial purposes uses vertical plates to form the ice. Each plate assembly consists of two plates which are welded at the periphery. Also, pattern welds are made at various points within the plates. Hydraulic pressure is applied between the plates to cause the plates to buckle outward and form passages between the plates for the passage of refrigerant.

A water distributor is mounted to one side of the plate at the top for distributing a stream of water over one side of the plate. The lower end of the plate extends into a trough for recirculating the water. Normally, two of the plates will extend into each trough. Each plate is bent so that the refrigerant portion is located on a vertical line outward of the edges of the trough. After the ice builds up on the outer sides of each plate assembly to a selected thickness, a warm refrigerant is circulated through to cause the sheet of ice to break loose and fall. Alternately, warm water is sprayed on the back side of the plate to warm the plate and release the ice. The ice falls vertically downward past the edge of the trough into a storage container.

While this type of ice making device is successful, one drawback is that each plate assembly forms ice only on one side of the plate assembly. One-half of the refrigerant surface of each plate assembly is wasted. One-half of the refrigerant surface of the plate assembly is exposed to ambient air between the two plate assemblies. This results in a loss of refrigerating energy because of heat infiltration into the space between the two plate assemblies.

Another type of ice making machine locates the vertical refrigerant portion directly above the trough. A deflecting grid is positioned above the trough and below the refrigerant portion. The deflecting grid has openings for the water stream to flow through. When the ice is released, the grid deflects the ice outward and down into a collection bin. In practice, the grids do not always work well. The impact of ice on the grid sometimes causes small pieces of ice to penetrate through the grid into the trough below. This is wasteful of usable ice production. Also, if the temperature of the supply water is low enough so that most of the ice particles penetrating the grid do not melt before the next ice harvest, then the ice below the grid will build up. This could block the flow of the recirculated water to the water pump or block the flow of the water through the grid, causing the water to flow out into the ice collecting chamber.

Movable deflectors are also used these devices are effective, but have the disadvantage of a mechanical movable device which is subject to malfunction.

SUMMARY OF THE INVENTION

In the ice making apparatus of this invention, ice is formed on both sides of each plate assembly. Each plate assembly includes two plates welded together along longitudinal welds. Pattern welds define passages for the coolant. The plate assembly leads into a trough.

Water is distributed at the top to flow over the refrigerant portion and into the trough.

The refrigerant portion is located vertically above and centered in the trough. A deflecting area is positioned a selected distance below the refrigerant portion and above the trough. The deflecting area includes an outward inclined section that inclines downward and outward. A curved section joins the outward inclined section and leads to an inward inclined section. The inward inclined section or sections extends to the centerline of the two plates where a vertical section extends downward into a groove in the center of the water trough. Water flows over the outward inclined section, the curved section and into the trough. The outward inclined section deflects the sheet of ice as it is released.

DESCRIPTION OF THE PREFERRED EMBODIMENT

Figure 1A:
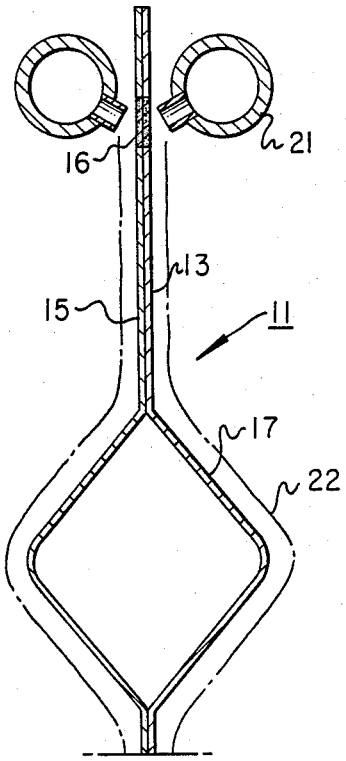
FIGS. 1*a* and 1*b* are a vertical sectional view illustrating an ice making apparatus constructed in accordance with this invention.

Referring to FIG. 1*a*, a plate assembly 11 for making ice as shown. Plate assembly 11 is made up of two metal sheets or plates 13, 15. Plates 13, 15 are welded together near the top by a seam weld 16. A deviation section 17 is located a short distance below the seam weld 16. In the deviation section 17, the plates 13, 15 are each bent outward and inward in a generally triangular shape. This results in a diamondshaped space between the two plates 13, 15. An upper longitudinal or peripheral weld 19 joins the plates 13, 15 together immediately below the deviation section 17.

A water distributor 21 is located on each outer side of each plate 13, 15. The water distributor 21 is a long tube having a series of closely spaced holes on one side on one side to discharge a stream of water 22 along the outer side of each plate 13, 15. In the alternative, the water distributor 21 may be a flat pan above the plates 13, 15 with a series of closely spaced holes in the bottom located in lines slightly on either side of the centerline of the plates 13, 15.

Deviation section 17 increases the width of the plate assembly 11 near the upper edge of the plate assembly to make it easier to have water flow onto the plates 13, 15 from the water distributor 21. This makes alignment of the water distributor 21 with the plates 13, 15 less critical. Also, the almost square, tubelike structure formed by the deviation section 17 adds greatly to the longitudinal rigidity of the plate assembly 11. The outermost portions of the deviation section 17 are gradual curves to retain the stream of water in contact with the deviation section 17 as it flows around the deviation section 17.

Figure 1B:
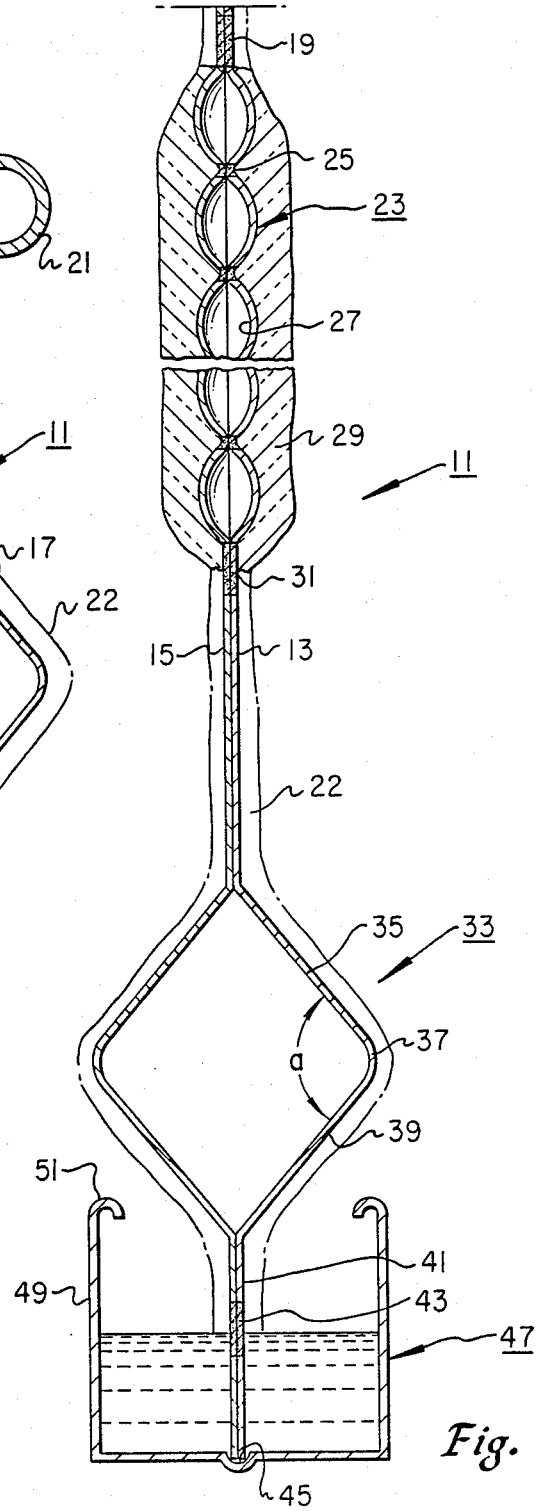

Referring to FIG. 1*b*, a refrigerant portion 23 is located below the upper peripheral weld 19. The refrigerant portion 23 has a large number of pattern welds 25 formed in it. The welds 25 are spaced at various distances from each other both vertically and horizontally, joining the plates 13, 15 at each pattern weld. During manufacturing, hydraulic pressure is applied between the plates 13, 15 to buckle the plates 13, 15 outward.

The plates 13, 15 permanently yield outward into generally elliptical pockets or passages 27.

The design of the passages 27 will provide a selected flow path for a refrigerant such as freon, ammonia, or cold brine to flow through to chill the plates of the refrigerant portion 23. The refrigerant will contact the inner surfaces of each plate 13, 15, removing heat in an effective heat transfer relation. The technique to form the refrigerant portion 23 is a known process. The stream of water 22 will flow over the outer sides of the plates 13, 15 in the refrigerant portion 23. Ice 29 will build up into a sheet.

A lower peripheral weld 31 is located at the lower end of the refrigerant portion 23. The lower peripheral weld 31 is a longitudinal seam weld joining the plates 13, 15 at that point. A deflection area 33 is located a selected distance below the lower peripheral weld 31. The distance between the deflection area 33 and the refrigerant portion 23 is selected to allow the ice sheets 29 to accelerate when released from the refrigerant portions 23, so that they have enough momentum to overcome the sheer strength of a water film that forms between them and the plates 13, 15 during harvesting. This should be at least one inch. The deflection area 33 is similar in shape to the deviation section 17, but larger.

Deflection area 33 includes an outward inclined section 35 that extends outward and downward. The outward inclined section 35 is formed by bending each plate, 13, 15, and thus is an integral portion of each plate 13, 15. The outward inclined section 35 is straight and preferably at an angle of 45 degrees relative to a vertical axis extending through the plates 13, 15.

A curved section 37 joins the outward inclined section 35. The curved section 37 is at a radius that is selected to cause the stream of water 22 to adhere to the curved section 37 as it flows around the curved section 37. This, of course, depends upon the velocity of the water. A higher velocity provides more effective heat transfer. However, it requires a larger radius for the curved section 37 to guide the water smoothly around. Experience shows that water flows on a vertical plate can be between 0.055 and 0.524 gallons per minute per horizontal inch (gpm/inch) of plate width per side. Flows below 0.055 gpm/inch are not sufficient to wet the width of the plate, and tend to run down the plate in individual rivulets, leaving vertical strips of the plate dry and not in contact with the water. A falling liquid film, above certain Reynolds numbers, forms waves as the liquid flows down the plate. Flows above 0.524 gpm/inch will not cling to the vertical surface because the wave formations are "breaking". Water loses contact with the plate and is lost. The greatest wave amplitude measured without "breaking" of the wave is about 0.08 inches. The average film thickness is between 0.02 inches and 0.03 inches depending upon the flow rate and the surface smoothness of the plate.

An inward inclined section 39 joins the lower termination of the curved section 37. In the embodiment of FIGS. 1*a* and 1*b*, the inward inclined section 39 is preferably also at a 45 degree angle. The curved section 37 is formed at a radius that joins the outward inclined section 35 with the inward inclined section 39. A line tangent to the upper termination of the curved section 37 is an extension of the outward inclined section 35. A line tangent to the lower termination of the curved section 37 is an extension of the inward inclined section 39. The included angle "a" between these two lines and between the sections 35 and 39 is preferably in the range from 90 to 135 degrees. In the embodiment shown in FIG. 1*b*, which is for moderate flow rates, angle "a" is 90 degrees.

The inward inclined section 39 of each plate 13, 15 extends downward into a lower vertical section 41 located on the centerline of the plates 13, 15. The two plates 13, 15 contact each other in the lower vertical section 41. A longitudinal seam weld 43 extends along the lower vertical section 41.

The lower vertical section 41 extends into a longitudinal groove 45 located in the bottom of a water trough 47. The engagement of the lower vertical section 41 with the groove 45 aligns the water trough 47 with the plates 13, 15. The water trough 47 serves as a means to recirculate the water stream 22 back to a pump (not shown) which returns the water stream 22 to the water distributor 21.

Trough 47 has a pair of sidewalls 49, which preferably are parallel vertical walls. Each sidewall 49 has an upper edge 51. Each upper edge 51 is located below one of the inward inclined sections 39. The distance between the outer surfaces of the curved sections 37 is substantially the same as the distance between the upper edges 51. The outer surface of each curved section 37 is in substantial vertical alignment with an upper edge 51 of the trough 47. Groove 45 is located equidistant between the two sidewalls 49.

In operation, water flows from the water distributors 21 onto the outer surface of each plate 13, 15. The water flows around the deviation sections 17 and down onto the refrigerant portion 23. The water continues to flow down past the refrigerant portion 23 and around the deflection area 33. The water will flow down the inward inclined section 39 and into the trough 47. The water is recirculated by a pump back to the water distributors 21.

A refrigerant coolant fluid is circulated through the passages 27. This removes heat from the water and causes it to build up ice 29 on each side of the refrigerant portion 23. The ice 29 will continue to build until a selected thickness is achieved. This can be handled by a timer or by a sensor which monitors the thickness. Typically the ice 29 will build up to a thickness from about $\frac{3}{8}$ inch to $\frac{3}{4}$ of an inch.

Then, the ice 29 will be harvested. Low temperature refrigerant flow is shut off. High temperature refrigerant is introduced into the passages 27 to warm the plates 13, 15. The high temperature refrigerant can be superheated discharge gas from the refrigeration compressor (not shown), saturated vapor from the receiver (not shown), or unexpanded liquid from the receiver. When the plates 13, 15 are heated, a thin film of water will form between the ice sheet 29 and the surface of the plates 13, 15. The ice sheet 29 will begin to move downward and accelerate. Each ice sheet 29 will strike an outward inclined section 35 and be deflected outward. Each ice sheet 29 will fall past the sidewalls 49 of the trough 47 into a collection bin.

The cycle will then be repeated. Typically, the ice making machine will harvest forty to seventy times per day. The ice sheet 29 could weigh as much as forty to fifty pounds. The ice sheet 29 could be as high as four feet and as long as seven to eight feet.

Figure 2:
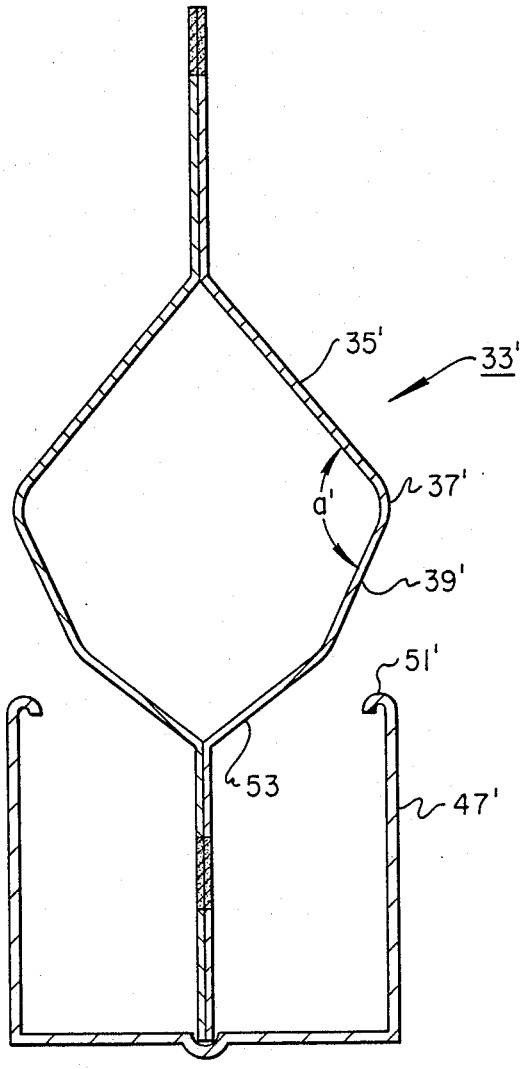
FIG. 2 is a partial vertical sectional view illustrating an alternate embodiment of an ice making apparatus constructed in accordance with this invention.

An alternate embodiment is shown in FIG. 2. In this embodiment, prime symbols will be used to indicate similar components. The deflecting area 33' differs from the deflecting area 33 of FIG. 1*b* in that the angle a' between the outward inclined section 35' and the inward inclined section 39' is at a greater angle than that shown in FIG. 1*b*. This greater angle results in a greater radius of curvature of the curved section 37'. The inclination of the outward inclined section 35' is the same or greater than the inclination of the outward inclined section 35.

The inclination, however, of the inward inclined section 39' is considerably greater than the inclination of the inward inclined section 39. Preferably, the inclination is from 56 to 62 degrees relative to a horizontal line, while the inclination of the inward inclined section 39 is 45 degrees. The included angle a' is preferably from 101 to 124 degrees. The configuration of the curved section 37 preferably closely approximates the potential flow curve for a fluid flowing around a curve. This allows for higher flow rates for the water stream than in the embodiment of FIGS. 1*a* and 1*b*.

The inward inclined section 39' extends down a selected distance and joins a lower portion 53 of inward inclined section 39'. The lower portion 53 will be approximately at a 45 degree angle relative to horizontal. The junction between the inward inclined section 39' and the lower portion 53 is located well over the trough 47'. The water can freely fall off at this point into the trough 47' without any detrimental effect. The clearance between the upper edge 51' and the sections 39' and 53 is reduced over that shown in FIG. 1*b*. This also reduces the chance for an ice sheet from an adjacent plate to hang up on the water trough 47'.

The invention has significant advantages. Ice forms on both sides of the plate assemblies. This makes the heat transfer more efficient and reduces the loss in energy over the prior art type wherein ice was formed only on one side. The deflecting area deflects the ice sheet away from the trough to assure complete harvesting of the ice sheet. The large tube-like structure of the deflecting area provides rigid strength to withstand the force of the deflected ice sheets.

While the invention has been shown in only two of its forms, it should be apparent to those skilled in the art that it is not so limited, but is susceptible to various changes without departing from the scope of the invention.

I claim:

1. An ice making apparatus, comprising in combination:

a pair of plates welded together with spaced apart upper and lower longitudinal welds, having inner wall surfaces facing each other and outer wall surfaces facing in opposite directions from each other;

a refrigerant portion defined by the longitudinal welds, the refrigerant portion having a plurality of pattern welds between the plates, the plates being spaced apart from each other between the pattern welds to define coolant passages for receiving a cold refrigerant fluid to flow in contact with the inner wall surfaces to chill the plates in the refrigerant portion to form ice, and in alternating sequence a warm refrigerant fluid to warm the plates to release the ice;

water supply means for discharging a stream of water onto the outer wall surface of each plate above the refrigerant portion for flowing over the refrigerant portion to form the ice;

a trough located at the bottom of the plates for receiving water from the water supply means after it has flowed over the refrigerant portion; and a deflecting area below the lower longitudinal weld on the outer side of each plate, each deflecting area having an outward inclined section located above the trough and extending outward and downward from each plate for directing ice outward past the trough when released from the plates, each deflecting area having a inward inclined section, each deflecting area having a curved section joining the inward inclined section and the outward inclined section, each outward inclined section and each curved section being a solid sheet of impervious metal for causing all of the water flowing from the water supply means to flow over the outward inclined section, around the curved section and into the trough.

2. The apparatus according to claim 1 wherein the distance between the outer surfaces of the curved sections is at least substantially equal to the width of the trough.

3. An ice making apparatus, comprising in combination:

a pair of plates welded together with spaced apart upper and lower longitudinal welds, having inner wall surfaces facing each other and outer wall surfaces facing in opposite directions from each other;

a refrigerant portion defined by the longitudinal welds, the refrigerant portion having a plurality of pattern welds between the plates, the plates being spaced apart from each other between the pattern welds to define coolant passages for receiving a cold refrigerant fluid to flow in contact with the inner wall surfaces to chill the plates in the refrigerant portion to form ice, and in alternating sequence a warm refrigerant fluid to warm the plates to release the ice;

water supply means for discharging a stream of water onto the outer wall surface of each plate above the refrigerant portion for flowing over the refrigerant portion to form the ice;

a trough located at the bottom of the plates for receiving water from the water supply means after it has flowed over the refrigerant portion;

a deflecting area below the lower longitudinal weld on the outer side of each plate, each deflecting area having an outward inclined section located above the trough and extending outward and downward from each plate for directing ice outward past the trough when released from the plates, each deflecting area having a inward inclined section, each deflecting area having a curved section joining the inward inclined section and the outward inclined section for causing the water flowing from the water supply means to flow over the outward inclined section, around the curved section and into the trough; and each of the deflecting areas being integrally formed with one of the plates, the plates being separated from each other between the inclined sections and the curved sections.

4. An ice making apparatus, comprising in combination:

a pair of plates welded together with spaced apart upper and lower longitudinal welds, having inner wall surfaces facing each other and outer wall surfaces on the opposite sides;

a vertical refrigerant portion defined by the longitudinal welds, the refrigerant portion having a plurality of pattern welds between the plates, the plates being spaced apart from each other between the pattern welds to define coolant passages for receiving a cold refrigerant fluid to flow in contact with the inner wall surfaces to chill the plates in the refrigerant portion to form ice, and in alternating sequence a warm refrigerant fluid to warm the plates to release the ice;

a deviation section located above the refrigerant portion, the deviation section being formed in each plate and having an outward inclined portion extending outward and downward from each plate, a downward curved portion joining the outward inclined portion, and an inward inclined portion extending downward and inward from each curved portion;

water supply means for discharging a stream of water onto the outer wall surface of each plate above the deviation section for flowing over the deviation section and the refrigerant portion to form the ice;

a trough located at the bottom of the plates for receiving water from the water supply means after it has flowed over the refrigerant portion;

an outward inclined section in each plate located below the refrigerant portion and above the trough and extending outward and downward for directing ice outward past the trough when released from the plates;

a downward curved section joining the outward inclined section on each plate for causing the water flowing from the water supply means to flow over the outward inclined section and around the curved section;

an inward inclined section extending downward and inward from each curved section; and a vertical lower section extending downward from each inward inclined section, the vertical lower sections being joined to each other.

5. The apparatus according to claim 4 wherein the trough has a bottom containing a groove and wherein the vertical lower sections of each plate extend into the groove for positioning the trough relative to the plate.

6. The apparatus according to claim 4 wherein the trough has sidewalls spaced from each side of the vertical lower sections, each sidewall having an upper edge located below each inward inclined section, and wherein the distance from an outermost surface of one of the curved sections to an outermost surface of the other of the curved sections is substantially the same as the distance between the upper edges of the sidewalls of the trough.

7. The apparatus according to claim 4 wherein an included angle between a line tangent to the upper termination of the curved section and the lower termination of the curved section is in the range from substantially 90 degrees to substantially 135 degrees.

8. In an ice making apparatus of the type having a pair of plates welded together with spaced apart upper and lower longitudinal welds, the plates having inner wall surfaces facing each other and outer wall surfaces on the opposite sides, a vertical refrigerant portion defined by the longitudinal welds, the refrigerant portion having a plurality of pattern welds between the plates, the plates being spaced apart from each other between the pattern welds to define coolant passages for receiving a cold refrigerant fluid to flow in contact with the inner wall surfaces to chill the plates in the refrigerant portion to form ice, and in alternating sequence a warm refrigerant fluid to warm the plates to release the ice, the improvement comprising in combination:

water supply means for discharging a stream of water onto the outer wall surface of each plate above the refrigerant portion for flowing over the refrigerant portion to form ice on both outer wall surfaces of the plates;

a trough located below the plates for receiving water from the water supply means after it has flowed over the refrigerant portion;

an outward inclined section in each plate located below the refrigerant portion and above the trough and extending outward and downward for directing ice outward past the trough when released from the plates;

a downward curved section joining the outward inclined section on each plate, the outward inclined section and the downward curved section being of solid impervious metal for causing all of the water flowing from the water supply means to flow over the outward inclined section and around the curved section;

an inward inclined section having an upper portion extending downward and inward from each curved section and a lower portion extending downward and inward from the upper portion at a lessor inclination relative to horizontal than the upper portion; and a lower vertical section extending vertically downward from the lower portion of each inward inclined section into the trough, the lower vertical sections of each plate being joined to each other.

9. The apparatus according to claim 8 wherein the upper and lower portions of the inward inclined sections are flat.

10. The apparatus according to claim 8 wherein the upper portion of each of the inward inclined sections inclines relative to horizontal at a greater angle than each outward inclined section.

11. In an ice making apparatus of the type having a pair of plates welded together with spaced apart upper and lower longitudinal welds, the plates having inner wall surfaces facing each other and outer wall surfaces on the opposite sides, a vertical refrigerant portion defined by the longitudinal welds, the refrigerant portion having a plurality of pattern welds between the plates, the plates being spaced apart from each other between the pattern welds to define coolant passages for receiving a cold refrigerant fluid to flow in contact with the inner wall surfaces to chill the plates in the refrigerant portion to form ice, and in alternating sequence a warm refrigerant fluid to warm the plates to release the ice, the improvement comprising in combination:

water supply means for discharging a stream of water onto the outer wall surface of each plate above the refrigerant portion for flowing over the refrigerant portion to form ice on both outer wall surfaces of the plates;

a trough located below the plates for receiving water from the water supply means after it has flowed over the refrigerant portion;

an outward inclined section in each plate located below the refrigerant portion and above the trough and extending outward and downward for directing ice outward past the trough when released from the plates;

a downward curved section joining the outward inclined section on each plate for causing the water flowing from the water supply means to flow over the outward inclined section and around the curved section;

an inward inclined section having an upper portion extending downward and inward from each curved section and a lower portion extending downward and inward from the upper portion at a lessor inclination relative to horizontal than the upper portion;

a lower vertical section extending vertically downward from the lower portion of each inward inclined section into the trough, the lower vertical sections of each plate being joined to each other;

the upper and lower portions of the inward inclined sections being flat;

the upper portion of each of the inward inclined sections inclining relative to horizontal at a greater angle than the upper portion of each inward inclined section;

the trough having a bottom containing a groove and the lower vertical sections of each plate extending into the groove for positioning the trough relative to the plate.

* * * * *